US005885109A

United States Patent [19]

Lee et al.

[11] Patent Number: 5,885,109

[45] Date of Patent: Mar. 23, 1999

[54] ELECTRICAL ADAPTERS

[76] Inventors: Chiu-Shan Lee; S. S. Chen Li, both of No. 23, Lane 19, Chang-Chun Rd., Hsintien City, Taipei County, Taiwan

[21] Appl. No.: 951,760

[22] Filed: Oct. 16, 1997

[51] Int. Cl.[6] ..... H01R 25/00

[52] U.S. Cl. ..... 439/652; 439/956; 439/131; 439/172

[58] Field of Search ..... 439/359, 131, 439/145, 137, 638, 652, 655, 651, 653, 956, 172

[56] References Cited

U.S. PATENT DOCUMENTS 4,659,161 4/1987 Holocomb ..... 439/652
5,658,158 8/1997 Milan ..... 439/652
5,702,259 12/1997 Lee ..... 439/137

*Primary Examiner*—Neil Abrams
*Assistant Examiner*—Yong Ki Kim
*Attorney, Agent, or Firm*—Rosenberg, Klein & Bilker

[57] ABSTRACT

An electrical adapter having a face panel with different blade and grounding prong insertion holes for receiving different electrical plugs, a track at its back side adapted to receive one of a set of plug members, a plug unit and a socket unit arranged at two opposite lateral sides so that a plurality of electrical adapters can be connected in series by plugging the plug unit of one electrical adapter into the socket unit of another, and an electrical circuit consisting of a voltage regulator, a voltmeter, a voltage stabilizer, a power switch and a surge absorber.

9 Claims, 19 Drawing Sheets

| CODE | APPLICATION AREA | SPECIFICATION |
|---|---|---|
| A | British standards: South Africa | 15A250V |
| B | British standards: HK, Malaysia, Uganda, Singapore, Arabian countries | 13A250V |
| C | British colonies, India | 5A250V<br>15A250V |
| D | China, New Zealand, Australia | 10A250V |
| E | Denmark | 15A250V |
| F | Middle East | 15A250V |
| G | Middle East | 15A250V |
| H | American standards: Taiwan, Japan, USA, Canada, Cuba, Venezuela, Costa Rica, Guam Dominique, Ecudor, Hawaii, Salvador, Haiti, Honduras, Maxico, Panama, Nicalagua<br>Philippines, Thanland, Guatemala, Paragua | 125V<br>250V |
| I | Taiwan, Japan, USA, Canada | 20A250V |
| J | Taiwan, Japan, USA, Canada | 15A250V |
| K | China | |
| L | Italy | 10-16A250V |
| M | Swiss | 10-16A250V |
| N | Taiwan, Japan, USA, Canada<br>China, Philippines, Tailand | 15A250V<br>250V |
| O | China, New Zealand, Australia | 250V |
| P | Russia, Europe | small electric home appliance 250V |
| Q | German, Europe (with side grounding) | 10-16A250V |
| R | Conventional British and Hong Kong Types | 250V |

FIG.18A

ELECTRICAL ADAPTERS

BACKGROUND OF THE INVENTION

The present invention relates to electrical adapters, and relates more particularly to such an electrical adapter which is so designed that a plurality of the same electrical adapters can be conveniently connected in series.

A variety of electrical plugs and sockets have been developed and intensively used for different electrical apparatus. Further, different countries have different specifications on electrical plugs and sockets. In order to connect different electrical plugs to different electrical sockets, different electrical adapters may be used. It is not economic to prepare a variety of electrical adapters simply for use in few chances.

SUMMARY OF THE INVENTION

The present invention has been accomplished under the circumstances in view. It is the main object of the present invention to provide an electrical adapter which can be used to connect a variety of electrical plugs to a variety of electrical sockets. According to the present invention, the electrical adapter comprises an adapter body, a face panel covered on a front side of the adapter body, and an electrical circuit mounted inside the adapter body, wherein the face panel comprises a plurality of grounding prong insertion holes longitudinally aligned in the middle adapted to receive grounding prongs of different electrical plugs, two first power contact blade insertion holes and two second power contact blade insertion holes bilaterally disposed at different elevations and adapted to receive power contact blades of different electrical plugs, a backward guide rod, a first sliding cover coupled to the backward guide rod by a slip joint and adapted to close the first power contact blade insertion holes, the first sliding cover having an upwardly backwardly extended sloping guide face at a front side corresponding to one grounding prong insertion hole, the first sliding cover being downwardly moved away from the first power contact insertion holes when a grounding prong of an electrical plug is inserted into one grounding prong insertion hole and forced against the sloping guide face of the first sliding cover, first spring means adapted to impart an upward pressure to the first sliding cover, causing the first sliding cover to close the first power contact blade insertion holes, a second sliding cover adapted to close the second power contact blade insertion holes, the second sliding cover having a top block at a front side thereof in the middle, the top block having a sloping guide face in the middle corresponding one grounding prong insertion hole, the top block being forced to move the second sliding cover upwardly away from the second power contact blade insertion holes when a grounding prong of an electrical plug is inserted into one grounding prong insertion hole and forced against the sloping guide face of the top block, second spring means adapted to impart a downward pressure to the second sliding cover, causing the second sliding cover to close the second power contact blade insertion holes; the adapter body comprises a plug unit at a first lateral side thereof and a socket unit at a second lateral side thereof, the size of the plug unit fitting that of the socket unit so that a plurality of electrical adapters can be connected in series by plugging the plug unit of one electrical adapter into the socket unit of another, a longitudinal coupling groove at its first lateral side and a pair of longitudinal coupling plates at its second lateral side, a tie hole pierced through one corner thereof and intersected with the longitudinal coupling groove, the longitudinal coupling plates having a respective through hole, the longitudinal coupling plates and the longitudinal coupling groove being so arranged that the longitudinal coupling plates of one electrical adapter are fitted into the longitudinal coupling groove of another when a plurality of electrical adapters are connected in series, permitting the through holes of the longitudinal coupling plates of one electrical adapter to be fastened to the tie hole of another electrical adapter by a fastening element.

BRIEF DESCRIPTION OF THE DRAWINGS

FIG. 3-A shows an alternate form of the electrical adapter according to the first embodiment of the present invention.

FIG. 5-A is a perspective view of an electrical adapter according to a second embodiment of the present invention.

FIG. 5-B shows en electrical adapter of the second embodiment connected to an electrical adapter of the first embodiment according to the present invention.

FIG. 7-A is a side plain view of FIG. 7.

FIG. 7-B is an exploded view of a part of an alternate form of the third embodiment of the present invention.

FIGS. 7-C~7-H show different alternate forms of the electrical adapter according to the third embodiment of the present invention.

FIG. 8-A is an exploded view of a back board for an electrical adapter according to a fifth embodiment of the present invention.

FIG. 8-B shows an alternate arrangement of the fifth embodiment of the present invention.

FIG. 8-C is an exploded view of a part of the fifth embodiment of the present invention, showing the plug unit retracted from the extended position.

FIG. 18-A shows a insertion hole-application country comparison table according to the present invention.

DETAILED DESCRIPTION OF THE PREFERRED EMBODIMENTS

Figure 3:
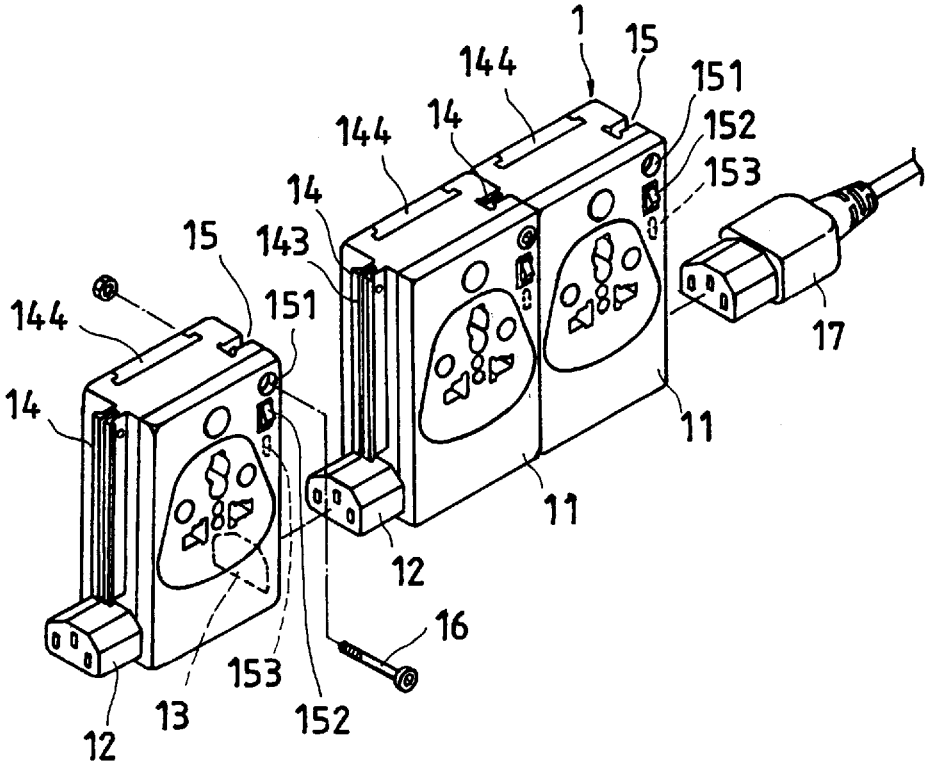
FIG. 3 is an applied view of the first embodiment of the present invention, showing a plurality of electrical adapters connected in series.
Figure 3A:
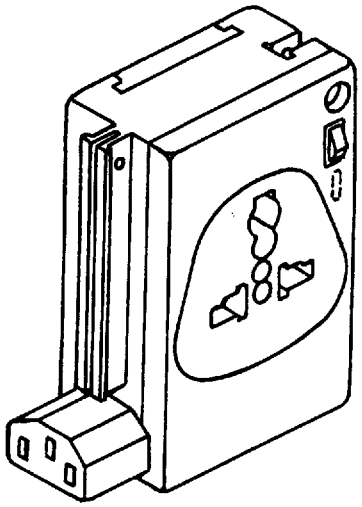
Figure 4:
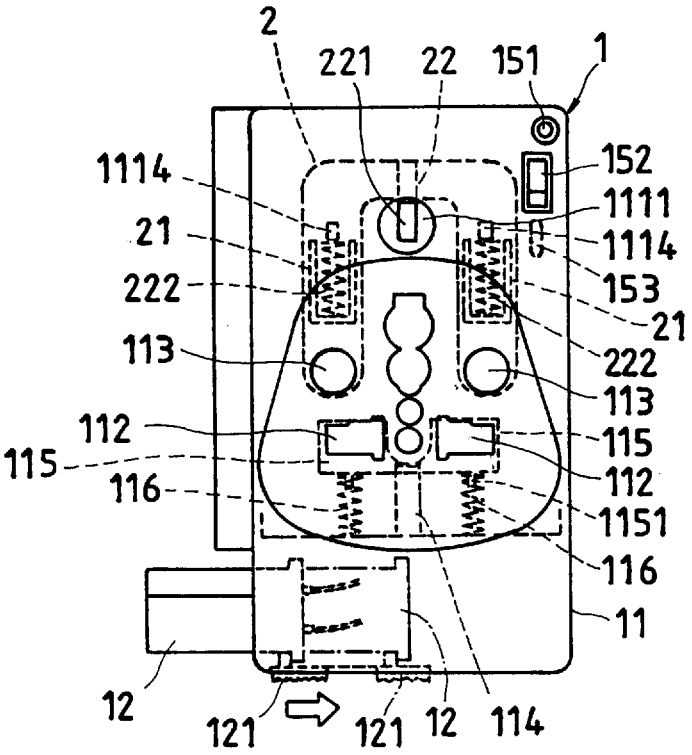
FIG. 4 is a front plain view of the electrical adapter shown in FIG. 1.

Referring to FIGS. from 1 to 5, an electrical adapter 1 is shown comprises a face panel 11 at its front side. The face panel 11 has a plurality of grounding prong insertion holes 1111;111;1112 longitudinally aligned in the middle, two first power contact blade insertion holes 112 bilaterally disposed at a lower elevation, two second power contact blade insertion holes 113 bilaterally disposed in the middle above the first power contact blade insertion holes 112. The first power contact blade insertion holes 112 are adapted to receive power contact blades of a variety of electrical plugs. The second power contact blade insertion holes 113 are adapted to receive power contact blades of an electrical plug made subject to related specifications issued by the Republic of South Africa. A guide rod 114 is provided at the back side of the face panel 11 inside the electrical adapter 1. A first sliding cover 115 is coupled to the guide rod 114 inside the electrical adapter 1 by a slip joint. The first sliding cover 115 has a longitudinal sliding slot 1151 in the middle, which receives the guide rod 114. Two spring elements 116 are mounted inside the electrical adapter 1 to support the first sliding cover 115. The spring elements 116 impart an upward pressure to the first sliding cover 115, thereby causing the first sliding cover 115 to close the first power contact blade insertion holes 112. The first sliding cover 115 has an upwardly backwardly extended sloping guide face 1152 at its front side. When two power contact blades 32 of an electrical plug 3 are respectively inserted into the first power contact blade insertion holes 112, they are perpendicularly forced against the sloping guide face 1152 of the first sliding cover 115, thereby causing the first sliding cover 115 to be lowered, for permitting the power contact blades 32 of the electrical plug 3 to be respectively inserted into position. A plug unit 12 and a socket unit 13 are provided at two opposite lateral sides of the electrical adapter 1 at the bottom. By means of fastening the plug unit 12 of one electrical adapter 1 to the socket unit 13 of another, a plurality of electrical adapters 1 are connected in series, and a power cable 17 can be connected to the socket unit 13 of the first piece of the series of electrical adapters 1 (see FIG. 3). The electrical adapter 1 further comprises a longitudinal coupling groove 15 and a pair of longitudinal coupling plates 141 respectively disposed at its two lateral sides, and a through hole 151 pierced through one corner thereof and intersected with the longitudinal coupling groove 15. The longitudinal coupling plates 141 are separated by a gap 143, having a respective through hole 142 corresponding to the through hole 151, and a respective hooked flange 14. When two electrical adapters 1 are connected together, the longitudinal coupling plates 141 and their hooked flanges 14 of one electrical adapter 1 are forced into engagement with the longitudinal coupling groove 15 of the other, and a screw bolt 16 is fastened to the through holes 151;142 to fix the two electrical adapters 1 together. A second sliding cover 2 is provided inside the electrical adapter 1, and adapted to close the second power contact blade insertion holes 113. The second sliding cover 2 has two pockets 21. Two spring elements 222 are respectively mounted on a respective stop rod 1114 inside the electrical adapter 1, and partially inserted into the pockets 21. The spring elements 222 impart a downward pressure to the second sliding cover 2, causing it to close the second power contact blade insertion holes 113. The second sliding cover 2 has a top block 22 with a sloping guide face 221 at its front side in the middle. When an electrical plug of South Africa specifications is inserted into the second power contact blade insertion holes 113 and the corresponding grounding prong insertion hole 1111, the grounding prong of the electrical plug is perpendicularly forced against the sloping guide face 221 of the second sliding cover 2, thereby causing the second sliding cover 2 to be lifted, for permitting the electrical plug to be inserted into position.

Figure 5:
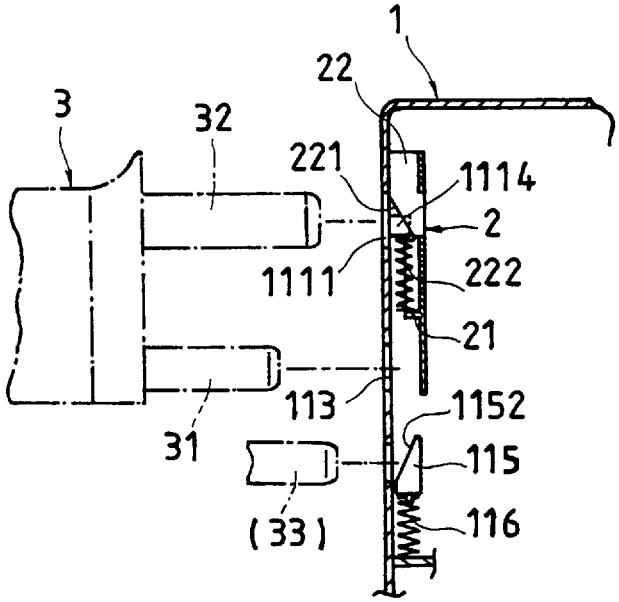
FIG. 5 is a side view in section of the electrical adapter shown in FIG. 1.
Figure 5A:
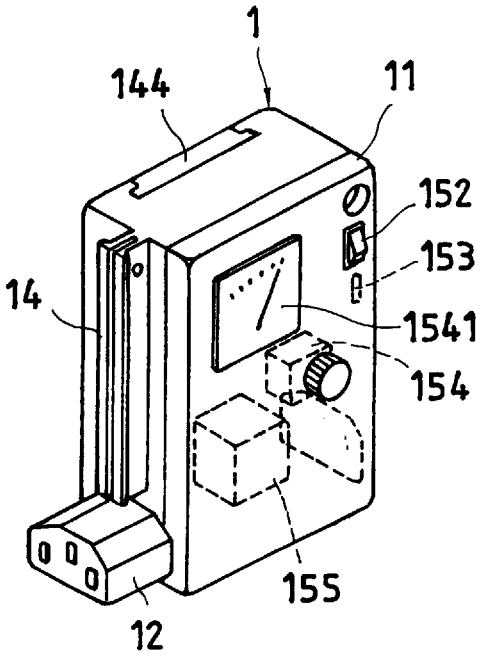
Figure 5B:
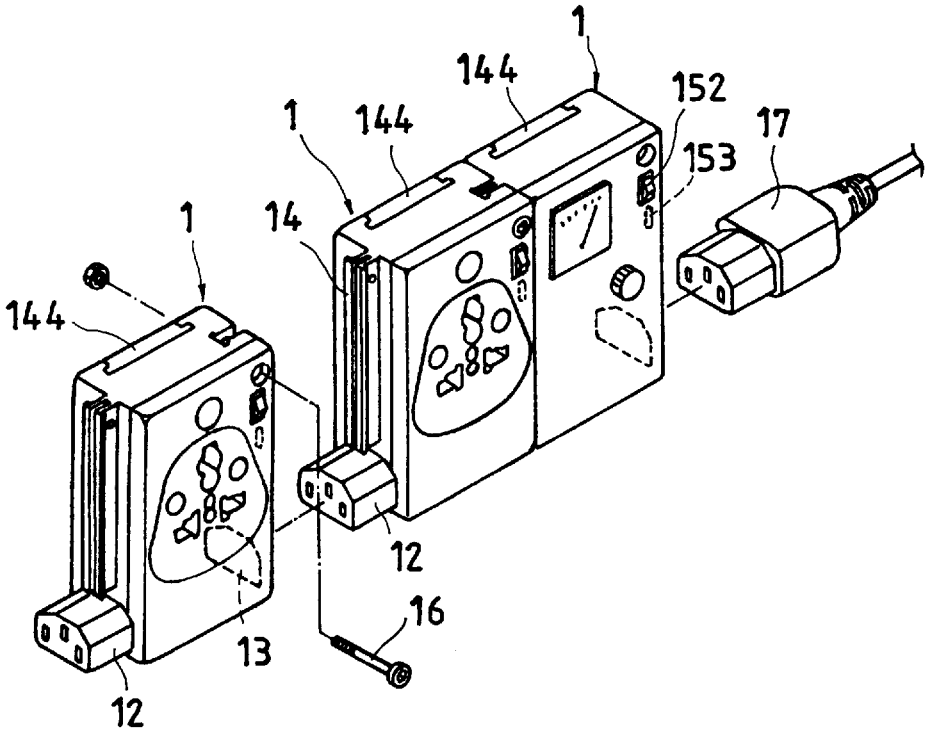

FIGS. 5-A and 5-B show an electrical adapter 1 made according to a second embodiment of the present invention. According to this embodiment, the electrical circuit of the electrical adapter 1 is comprised of a voltage regulator 154, a voltmeter 1541, a voltage stabilizer 152, a power switch 152, and a surge absorber 153.

Figure 6:
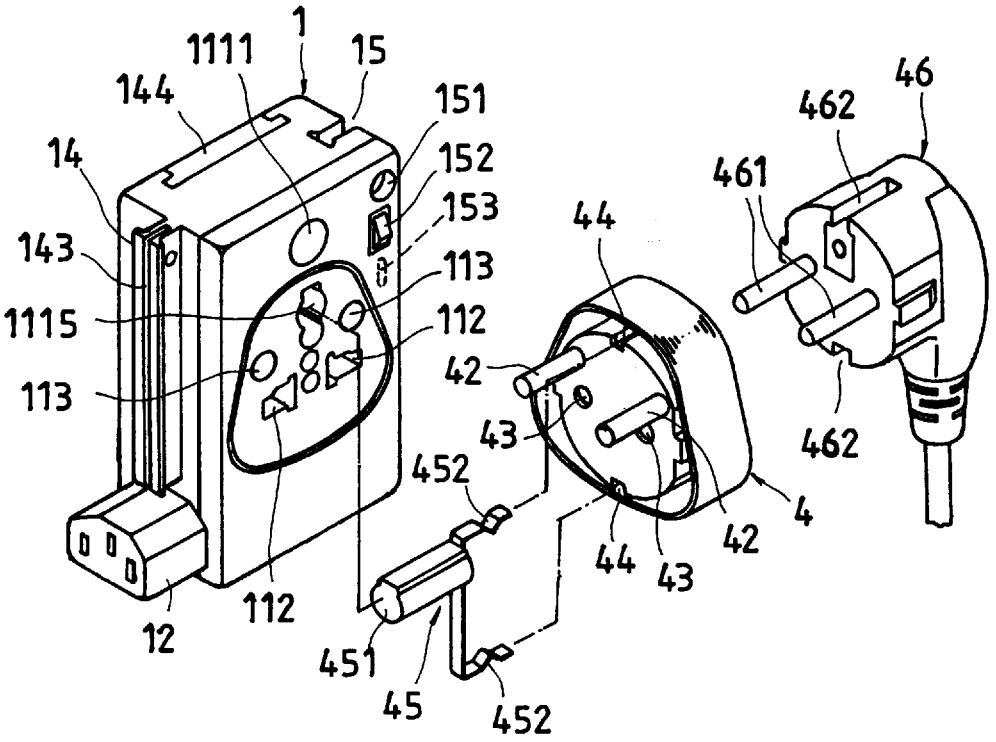
FIG. 6 is an exploded view of an electrical adapter according to a third embodiment of the present invention.
Figure 7:
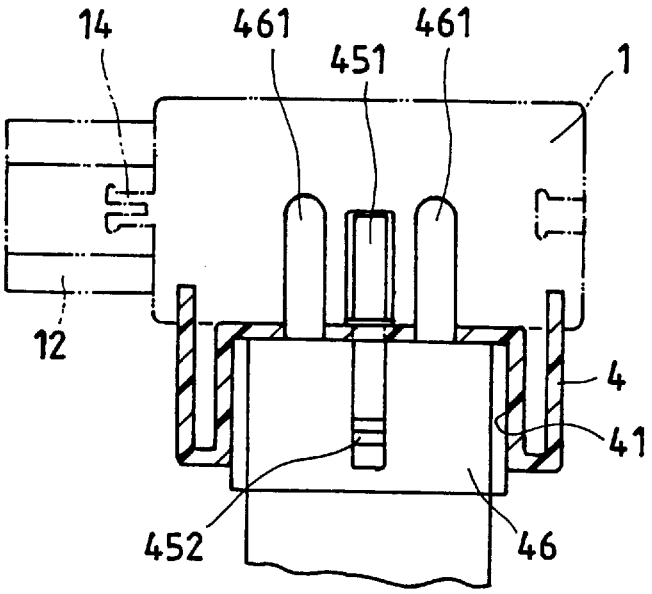
FIG. 7 is a top plain view showing the assembly of FIG. 6 assembled.
Figure 7A:
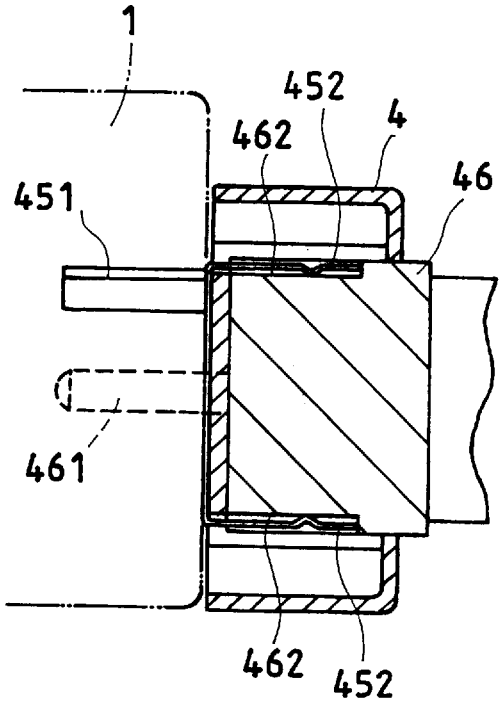
Figure 7B:
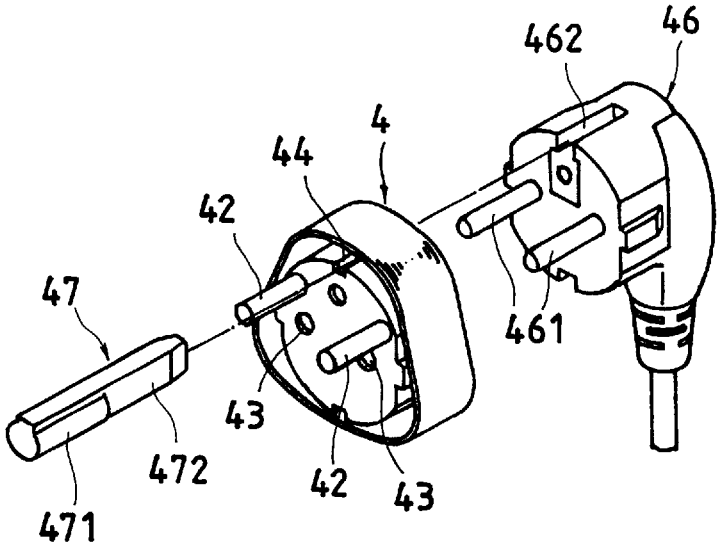
Figure 7C:
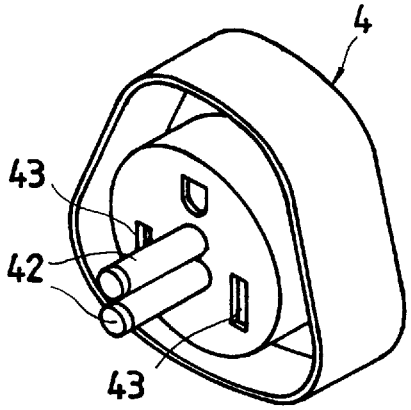
Figure 7F:
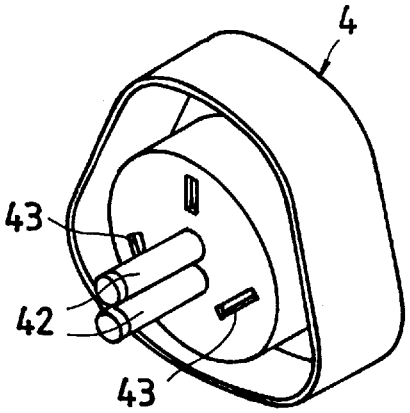
Figure 7D:
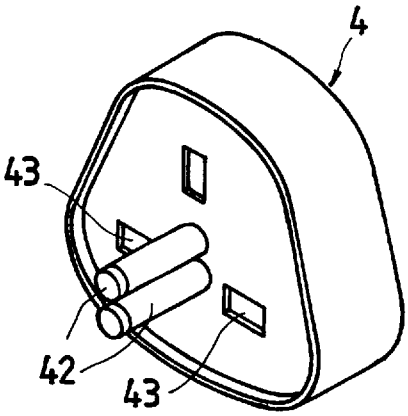
Figure 7G:
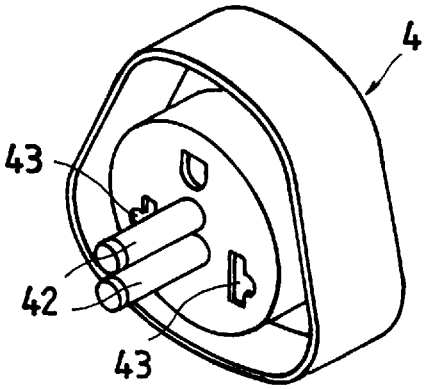
Figure 7E:
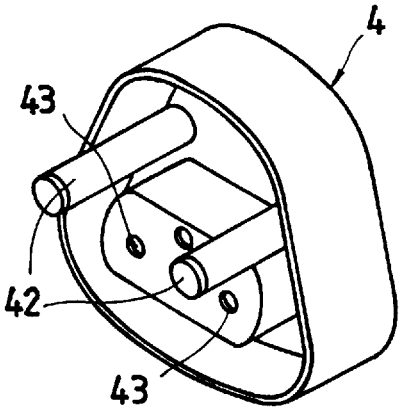
Figure 7H:
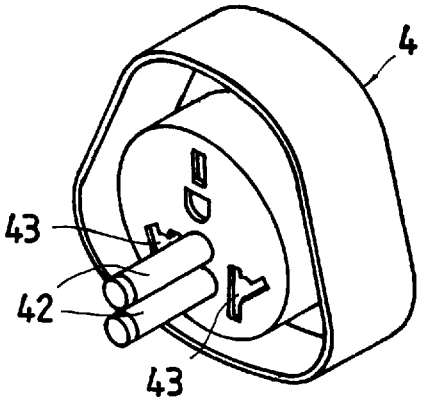

FIGS. 6, 7 and 7-A show an electrical adapter 4 according to a third embodiment of the present invention. An electrical adapter 4 according to this embodiment is adapted to receive an electrical plug of German specification 46. The electrical adapter 4 comprises a recessed chamber 41 at its front side for receiving the electrical plug of German specification 46, two through holes 43 disposed in the recessed chamber 41 and adapted to receive the two blades 461 of the electrical plug of German specification 46, two electrically insulative locating rods 42 raised its back side and adapted for inserting into for example the second power contact blade insertion holes 113 of the electrical adapter 1 of the first embodiment shown in FIG. 1, two grounding prong mounting holes 44 pierced through the recessed chamber 41, and a grounding prong 45 fastened to the grounding prong mounting holes 44. The grounding prong 45 comprises a prong body 451 adapted to insert into one grounding prong insertion hole 1115 in the grounding prong insertion hole 111 of the electrical adapter 1 of the first embodiment shown in FIG. 1, and two mounting legs 451 respectively mounted in the grounding prong mounting holes 44. When the electrical plug of German specification 46 is fastened to the electrical adapter 4, the mounting legs 451 of the grounding prong 45 are respectively inserted into two grooved grounding terminals 462 of the electrical plug of German specification 46.

Figure 1:
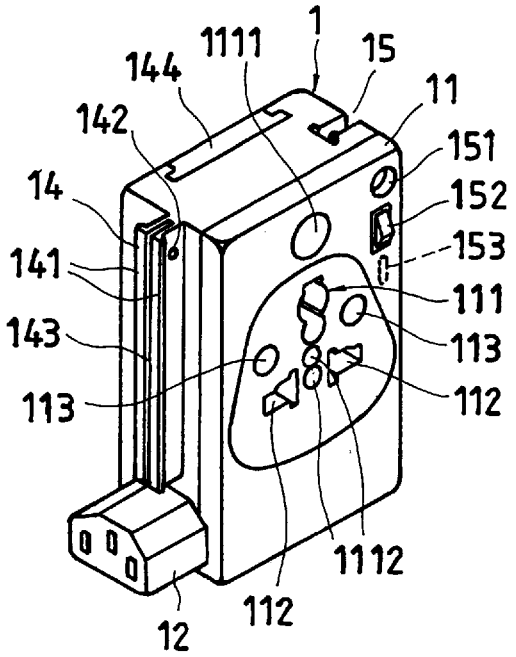
FIG. 1 is a perspective view of an electrical adapter according to a first embodiment of the present invention.
Figure 2:
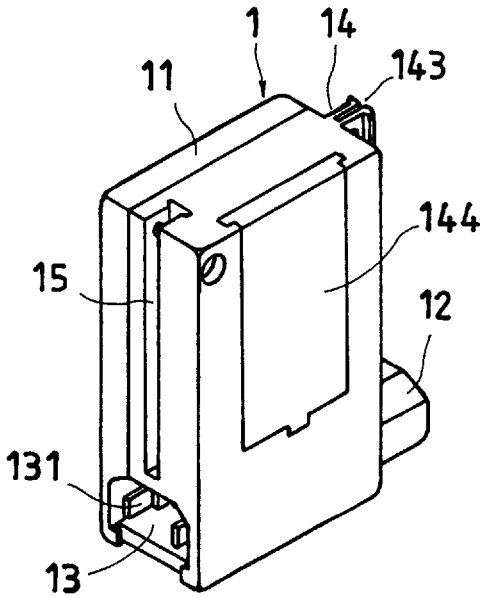
FIG. 2 is another perspective view of the electrical adapter shown in FIG. 1 when taken from another angle.

Referring to FIG. 7-B the grounding prong 47 comprises a prong body 47 adapted for fastening to one grounding prong insertion hole of the electrical adapter 1 shown in FIG. 1, and a rectangular mounting leg 472 adapted for fastening to one grounding prong mounting hole 44 of the electrical adapter 4.

FIGS. from 7-C to 7-H show different alternate forms of the electrical adapter 4. As indicated, the through holes 43 and the electrically insulative locating rods 42 may be variously arranged to fit different electrical plugs.

Figure 8:
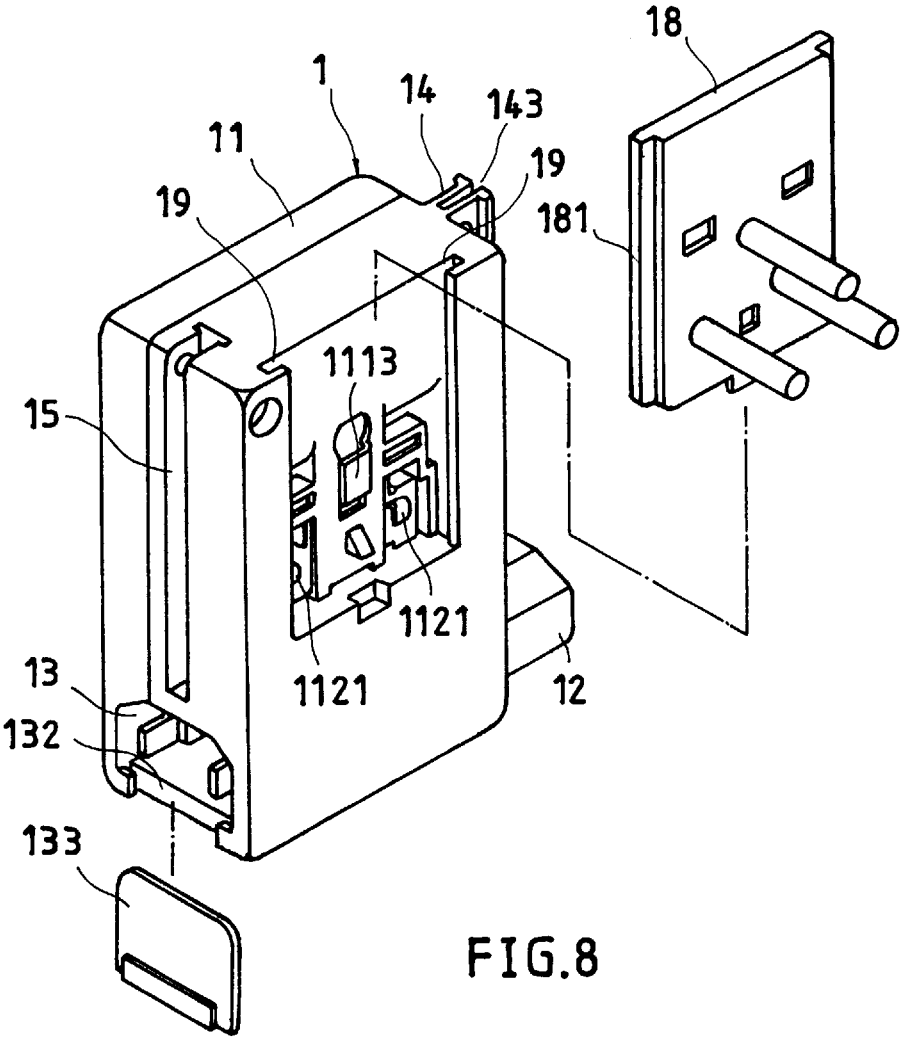
FIG. 8 is an exploded view of an electrical adapter according to a fourth embodiment of the present invention.
Figure 8A:
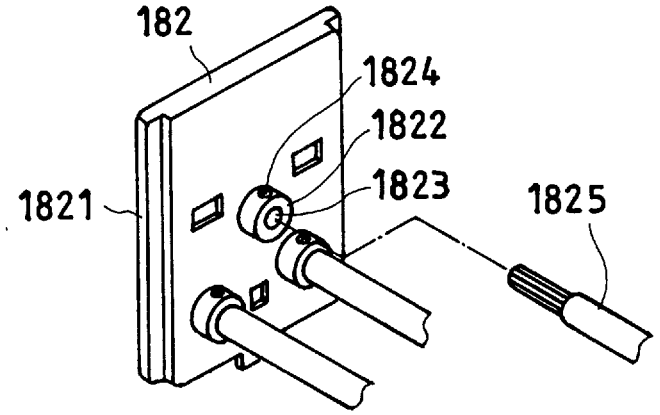
Figure 8B:
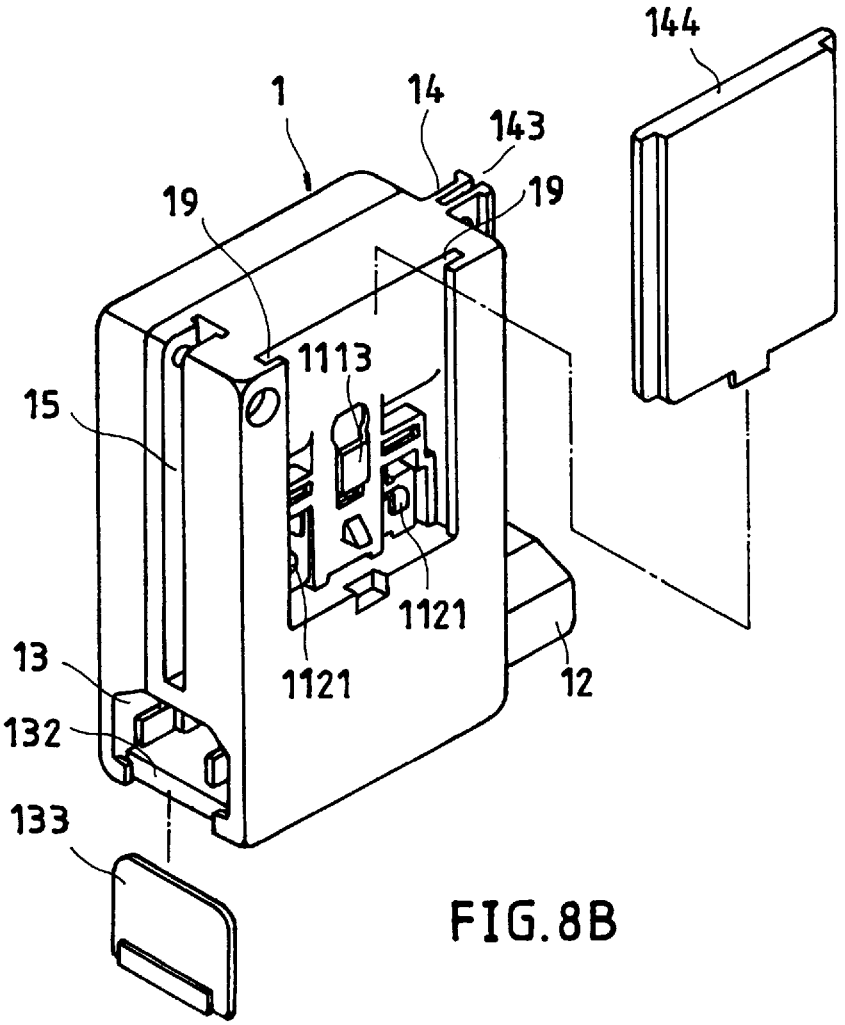
Figure 8C:
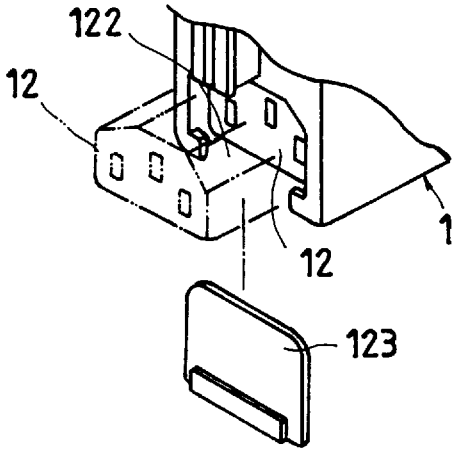
Figure 9:
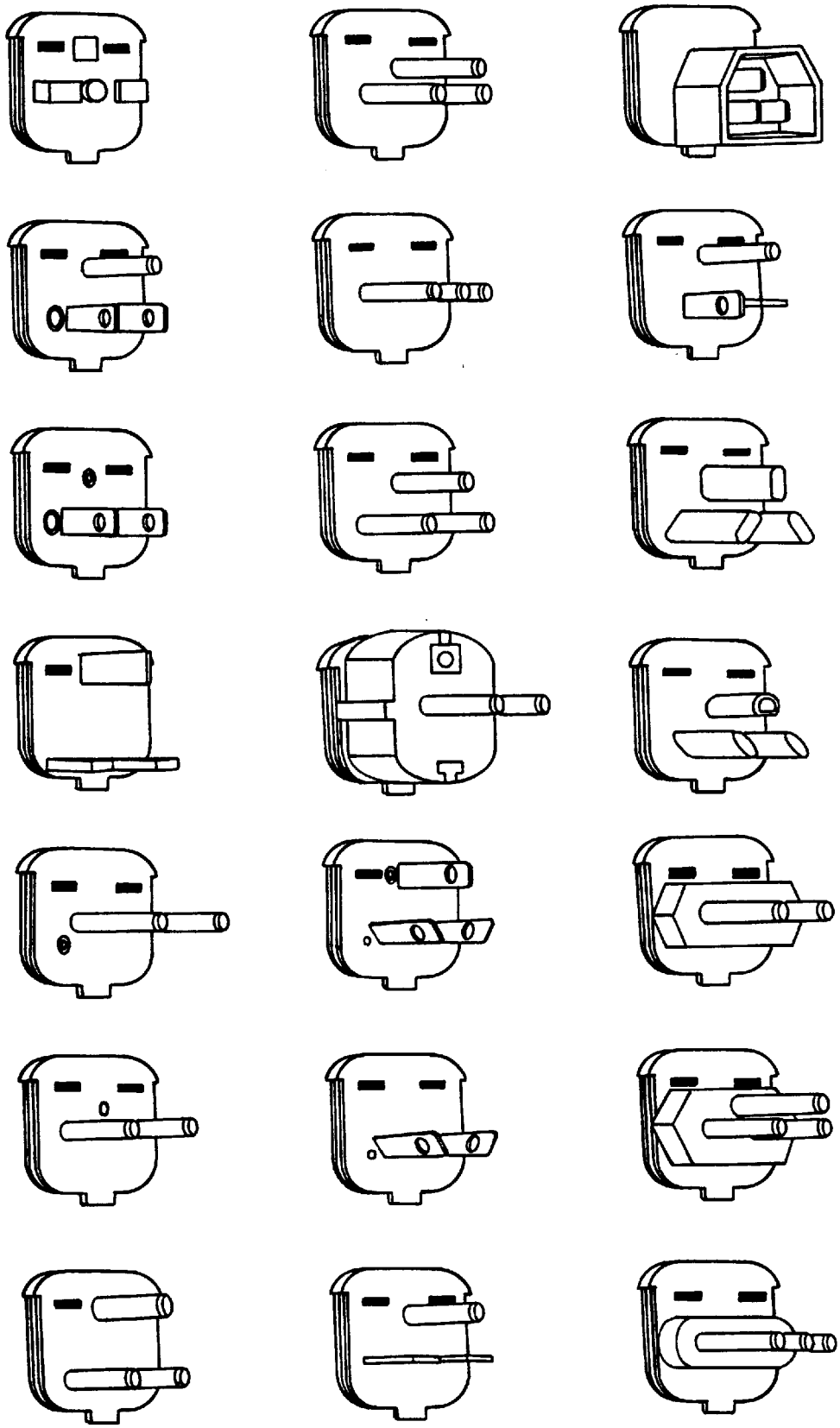
FIG. 9 shows different alternate forms of the plug member for the electrical adapter according to the fourth embodiment of the present invention.

FIGS. 8, 8-B and 8-C show an electrical adapter 1 according to a fourth embodiment of the present invention. According to this embodiment, the electrical adapter 1 has a track 19 at its back side adapted to hold a plug member 18. The plug member 18 has two rails 181 at two opposite sides adapted for inserting into the track 19. When the plug member 18 is inserted into the track 19, its blades and grounding prong are respectively forced into contact with respective power contacts 1121 and grounding contact 1113 of the electrical adapter 1. The plug member 18 may be variously embodied to fit different specifications (see FIG. 9). When the plug member 18 is removed from the electrical adapter 1, a cover plate 144 may be fastened to the track 19 to fill up the gap. Further, the plug unit 12 is retractable. Two tracks 122;132 are provided at two opposite lateral sides of the electrical adapter 1 corresponding to the plug unit 12 and socket unit 13. Two sliding cover plates 123;133 are provided for fastening to the tracks 122;132 to close the plug unit 12 and the socket unit 13. Of course, when to insert the sliding cover plate 123 into the track 122, the plug unit 12 must be pushed back to the inside of the electrical adapter 1.

According to a fifth embodiment according to the present invention, the back board, referenced by 182 (see FIG. 8-A), has two rails 1821 at two opposite sides adapted for inserting into the track 19 of the electrical adapter 1 (see also FIG. 8), a plurality of cylindrical wire holders 1822 defining a respective wire hole 1823 adapted to receive the hot wire, the neutral wire and the grounding wire respectively, and a plurality of tightening up screws 1824 respectively fastened to the cylindrical wire holders 1822 to fix the hot wire, the neutral wire and the grounding wire in place.

Figure 10:
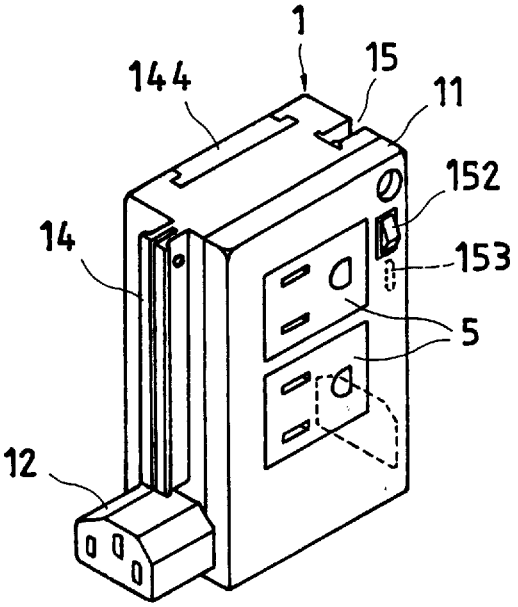
FIG. 10 is a perspective view of an electrical adapter according to a sixth embodiment of the present invention.
Figure 11:
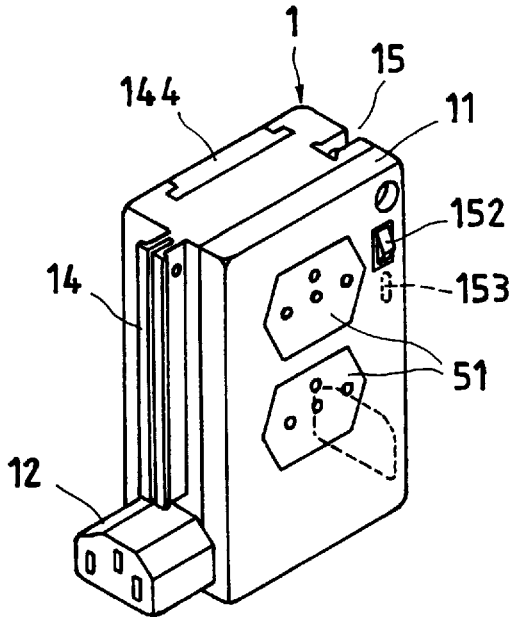
FIG. 11 shows an alternate form of the sixth embodiment of the present invention.
Figure 12:
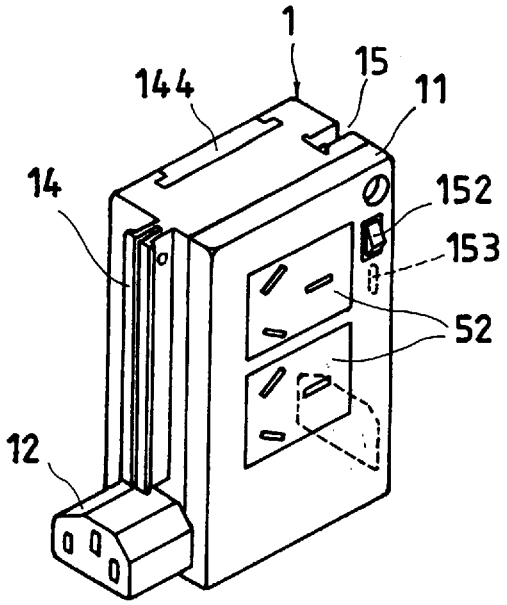
FIG. 12 shows another alternate form of the sixth embodiment of the present invention.

FIGS. 10, 11 and 12 show an electrical adapter 1 according to a sixth embodiment of the present invention. According to this embodiment, electrical socket members 5, 51 or 52 of a particular specification are integral with the electrical adapter 1 at the back side.

Figure 13:
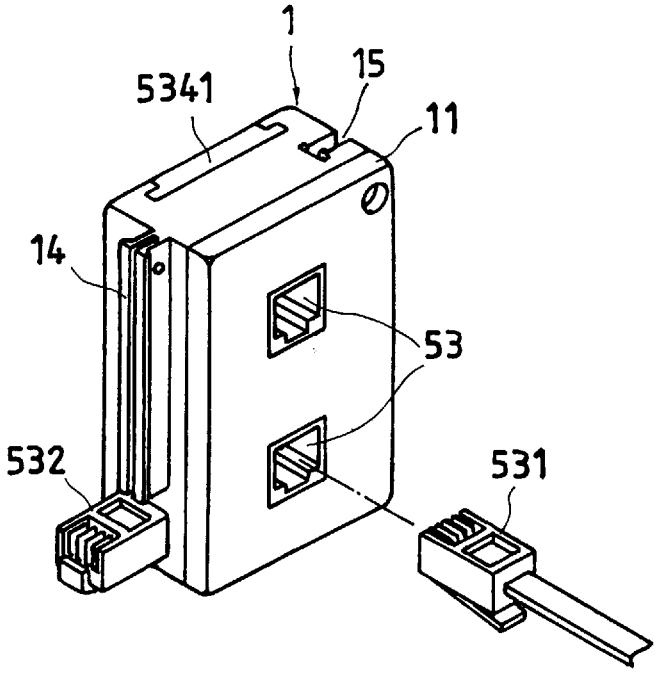
FIG. 13 is a perspective view of an electrical adapter according to a seventh embodiment of the present invention.
Figure 14:
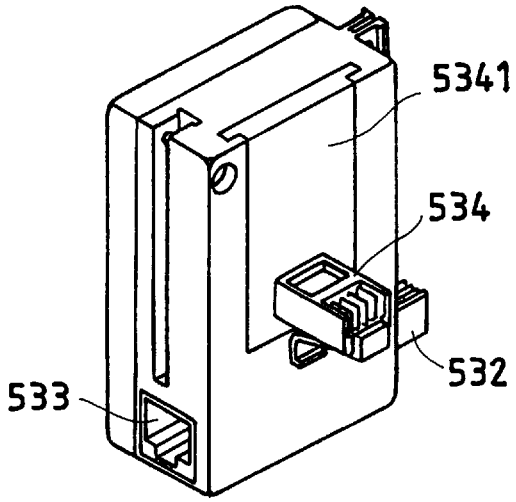
FIG. 14 is another perspective view of the electrical adapter shown in FIG. 13 when taken from another angle.

FIGS. 13 and 14 show an electrical adapter 1 according to a seventh embodiment of the present invention. According to this embodiment, the electrical adapter 1 comprises module jacks 53;533 at its front side and one lateral side, and module plugs 532;534 at its back plate 5341 an second lateral side. By plugging one module plug 532 or 534 of one electrical adapter 1 to one module jack 53 or 533 of another, a plurality of electrical adapters 1 according to the seventh embodiment of the present invention are connected in series. Through the module jacks 53;533 and module plugs 532;534, the electrical adapter 1 is used for connecting telephone lines 531.

Figure 15:
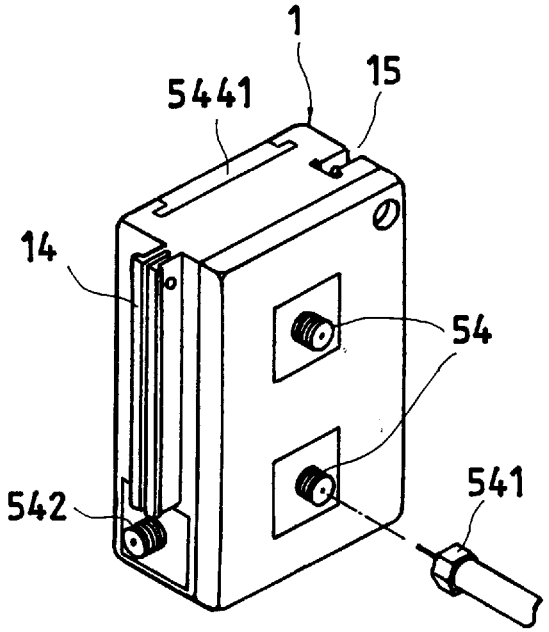
FIG. 15 is a perspective view of an electrical adapter according to an eighth embodiment of the present invention.
Figure 16:
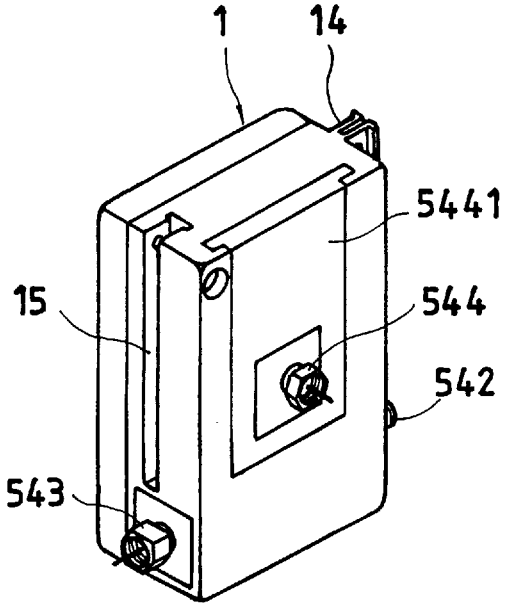
FIG. 16 is another perspective view of the electrical adapter shown in FIG. 15 when taken from another angle.

FIGS. 15 and 16 show an electrical adapter according to a eighth embodiment of the present invention. According to this embodiment, the electrical adapter 1 comprises female coaxial cable connectors 54;542 at its front side and one lateral side, and male coaxial cable connectors 544;543 at its back plate 5441 an second lateral side. By plugging male coaxial cable connector 544 or 543 of one electrical adapter 1 to one female coaxial cable connector 54 or 542 of another, a plurality of electrical adapters 1 according to the eighth embodiment of the present invention are connected in series. Through the male coaxial cable connectors 544;543 and female coaxial cable connectors 54;542, the electrical adapter 1 is used for connecting coaxial cables 531 for signal transmission.

Figure 17:
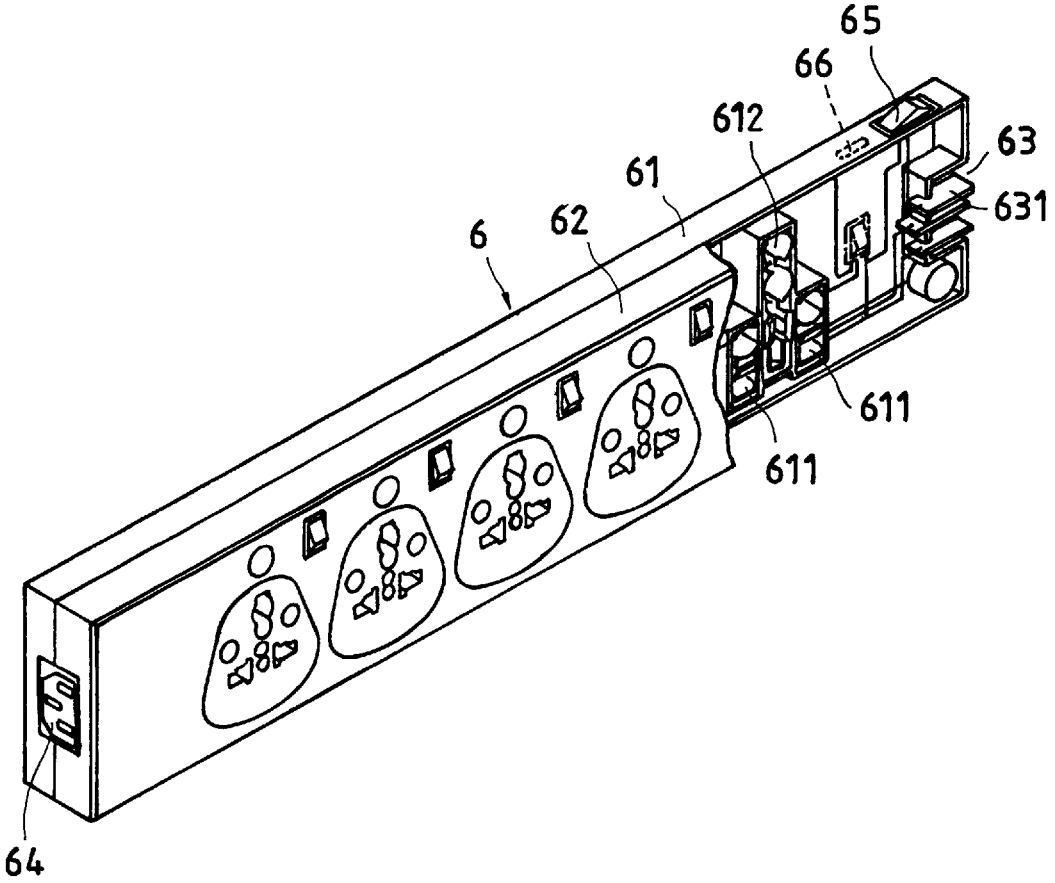
FIG. 17 is a perspective view of an electrical adapter according to a ninth embodiment of the present invention.

FIG. 17 shows an electrical adapter according to a ninth embodiment of the present invention. According to this embodiment, the electrical adapter 6 comprises a base plate 61, a face panel 62 covered on the base plate 61, a sets of power contact frames 611 and grounding contact frame 612, a power switch 65, a surge absorber 66, a recessed chamber 63 with power contact blades 631 and a socket 64 at two opposite ends.

Figure 18:
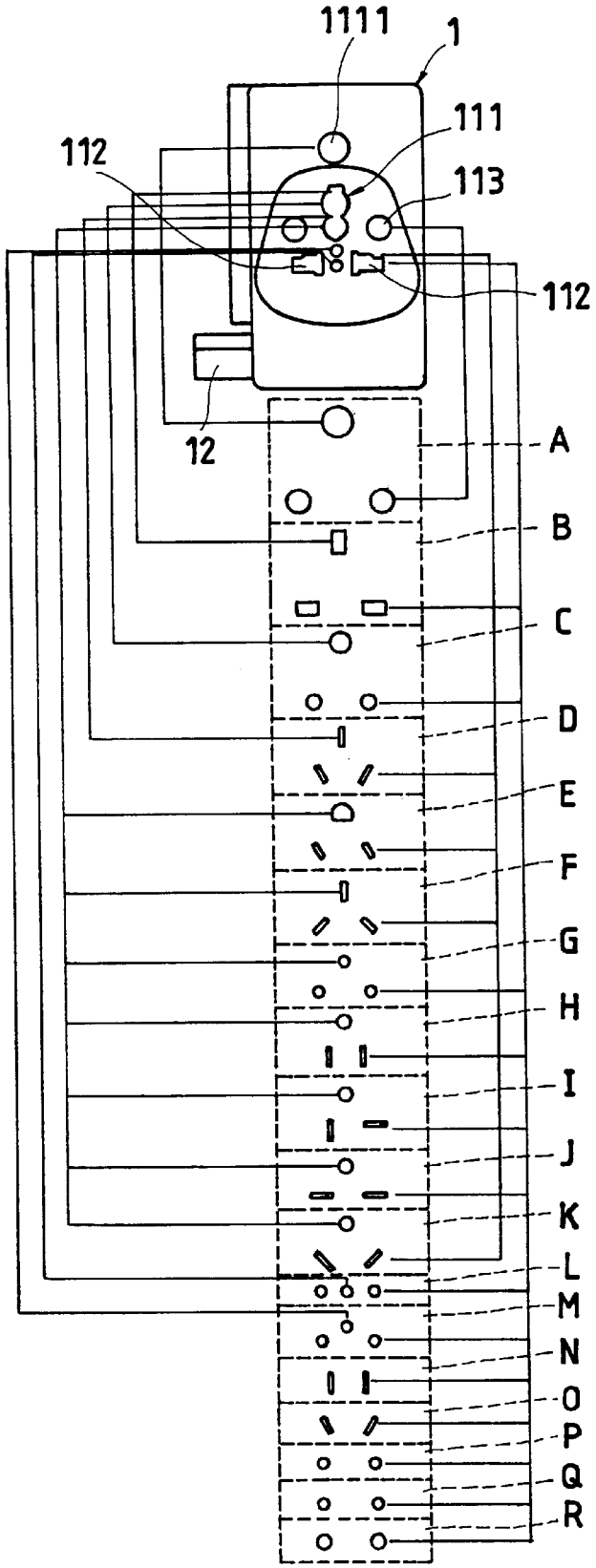
FIG. 18 shows a face panel with insertion holes for electrical plugs of different specifications.

FIG. 18 shows a face panel with insertion holes for electrical plugs of different specifications. FIG. 18-A shows a insertion hole-application country comparison table according to the present invention.

What the invention claimed is:

1. An electrical adapter comprising an adapter body, a face panel covered on a front side of said adapter body, and an electrical circuit mounted inside said adapter body, wherein said face panel comprises a plurality of grounding prong insertion holes longitudinally aligned a middle portion of said face panel adapted to receive grounding prongs of different electrical plugs, two first power contact blade insertion holes and two second power contact blade insertion holes bilaterally disposed at different elevations and adapted to receive power contact blades of different electrical plugs, a backward guide rod, a first sliding cover coupled to said backward guide rod by a slip joint and adapted to close said first power contact blade insertion holes, said first sliding cover having an upwardly backwardly extended sloping guide face at a front side corresponding to one grounding prong insertion hole, said first sliding cover being downwardly moved away from said first power contact insertion holes when a grounding prong of an electrical plug is inserted into one grounding prong insertion hole and forced against the sloping guide face of said first sliding cover, first spring means adapted to impart an upward pressure to said first sliding cover, causing said first sliding cover to close said first power contact blade insertion holes, a second sliding cover adapted to close said second power contact blade insertion holes, said second sliding cover having a top block at a front side thereof said top block having a sloping guide face corresponding to one grounding prong insertion hole, said top block being forced to move said second sliding cover upwardly away from said second power contact blade insertion holes when a grounding prong of an electrical plug is inserted into one grounding prong insertion hole and forced against the sloping guide face of said top block, second spring means adapted to impart a downward pressure to said second sliding cover, causing said second sliding cover to close said second power contact blade insertion holes; said adapter body comprises a plug unit at a first lateral side thereof and a socket unit at a second lateral side thereof, the size of said plug unit fitting that of said socket unit so that a plurality of electrical adapters can be connected in series by plugging the plug unit of one electrical adapter into the socket unit of another, a longitudinal coupling groove at its second lateral side and a pair of longitudinal coupling plates at its first lateral side, a tie hole pierced through one corner thereof and intersected with said longitudinal coupling groove, said longitudinal coupling plates having a respective through hole, said longitudinal coupling plates and said longitudinal coupling groove being so arranged that the longitudinal coupling plates of one electrical adapter are fitted into the longitudinal coupling groove of another when a plurality of electrical adapters are connected in series, permitting the through holes of the longitudinal coupling plates of one electrical adapter to be fastened to the tie hole of another electrical adapter by a fastening element.

2. The electrical adapter of claim 1, wherein said electrical circuit is comprised of a voltage regulator, a voltmeter, a voltage stabilizer, a power switch, and a surge absorber.

3. The electrical adapter of claim 1 further comprising an auxiliary electrical adapter adapted for connecting an electrical plug to said face panel, said auxiliary electrical adapter comprising a front recessed chamber adapted for receiving an electrical plug, two through holes pierced through said front recessed chamber corresponding to said first power contact blade insertion holes of said face panel and adapted for guiding two power contact blades of an electrical plug into said first power contact blade insertion holes of said face panel, two electrically insulative locating rods at a back side thereof adapted for mounting in said second power contact blade insertion holes of said face panel, and a grounding prong adapted for inserting into one grounding prong insertion hole of said face panel, the grounding prong of said auxiliary electrical adapter having contact leg means extended into said front recessed chamber and adapted to contact grounding terminal means of an inserted electrical plug.

4. The electrical adapter of claim 1, wherein said adapter body comprises a track at a back side thereof, a positive power contact terminal and a negative power contact terminal and a grounding terminal respectively mounted inside said track, and a sliding plug member inserted into said track, said sliding plug member having two power contact blades and a grounding prong respectively disposed in contact with said positive and negative power contact terminal and said grounding terminal.

5. The electrical adapter of claim 1, wherein said adapter body comprises a track at a back side thereof, a positive power contact terminal and a negative power contact terminal and a grounding terminal respectively mounted inside said track, and a sliding plate inserted into said track, said sliding plate comprising a plurality of cylindrical wire holders adapted to receive electrical wires, and a plurality of tightening up screws respectively mounted in said cylindrical wire holders and adapted to tightening up respective electrical wires in said cylindrical wire holders, permitting installed electrical wires to be retained in contact with said positive and negative power contact terminal and said grounding terminal.

6. The electrical adapter of claim 1, wherein said adapter body comprises a plurality of electrical sockets at a back side thereof.

7. The electrical adapter of claim 1, wherein said adapter body comprises a plurality of module jacks adapted for receiving module plugs of telephone lines, and a plurality of module plugs adapted for connecting to module jacks of telephone lines.

8. The electrical adapter of claim 1, wherein said adapter body comprises a plurality of female coaxial cable connectors adapted for receiving male coaxial cable connectors of electrical signal lines for signal transmission, and a plurality of male coaxial cable connectors adapted for connecting to female coaxial cable connectors of electrical signal lines.

9. The electrical adapter of claim 1, wherein said adapter body comprises two side tracks respectively disposed at its first and second lateral sides, and two sliding cover plates respectively mounted in said side tracks to close said plug unit and said socket unit.

* * * * *